US007547216B1

(12) United States Patent
Polnyl et al.

(10) Patent No.: US 7,547,216 B1
(45) Date of Patent: Jun. 16, 2009

(54) ELECTRICAL CONNECTOR ASSEMBLY WITH ALIGNMENT POSTS

(75) Inventors: Igor Polnyl, Aurora, IL (US); Fang-Jun Liao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/009,493

(22) Filed: Jan. 18, 2008

(51) Int. Cl.
*H01R 12/00* (2006.01)

(52) U.S. Cl. ..... 439/68; 439/526; 439/71

(58) Field of Classification Search ..... 439/68–73, 439/91, 330, 331, 525, 526, 564, 573
See application file for complete search history.

(56) References Cited

U.S. PATENT DOCUMENTS 5,322,446 A * 6/1994 Cearley-Cabbiness ..... 439/73
5,713,744 A * 2/1998 Laub ..... 439/71
6,347,955 B1 * 2/2002 Huang ..... 439/378
6,702,588 B1 * 3/2004 McHugh et al. ..... 439/71
7,207,808 B2 11/2005 Honhai
6,918,779 B2 11/2006 Honhai
7,241,149 B2 * 7/2007 Abadia ..... 439/75
7,361,028 B1 * 4/2008 Polnyl ..... 439/68
7,377,791 B2 * 5/2008 Liao et al. ..... 439/71
2004/0087202 A1 * 5/2004 Baccei et al. ..... 439/378
2007/0218758 A1 * 9/2007 Liao et al. ..... 439/593

* cited by examiner

*Primary Examiner*—James Harvey
(74) *Attorney, Agent, or Firm*—Wei Te Chung

(57) ABSTRACT

An electrical connector assembly (100) includes a frame (2) defining a central cavity (21) therein. A connector assembled to the central cavity and at least one alignment post (3) assembled to the frame (2). Each alignment post (3) defining a middle stop section (32) and an upper latching section (33) consisting of number of latching ribs (331) symmetrically arranged around a circle and a lower engaging section formed with a plurality of ribs around outer periphery; and the frame (2) defining at least one locating hole (23) for said alignment post (3) extending through. The frame (2) is sandwiched between the latching section (33) and the stop section (32) of the at least alignment post.

17 Claims, 3 Drawing Sheets

ELECTRICAL CONNECTOR ASSEMBLY WITH ALIGNMENT POSTS

BACKGROUND OF THE INVENTION

1. Field of the Invention

The present invention relates to the art of an electrical connector and more particularly to an electrical connector assembly including a number of alignment posts.

2. Description of the Related Art

Electrical connectors are widely used in the art of computers to provide electrical connection between chip packages and an electrical substrates, such as printed circuit board (PCB).

One conventional electrical connector assembly includes a surface mount land grid array (LGA) socket. The electrical connector assembly also includes a circuit board to which the LGA socket is mounted and a chip mounted on the LGA socket. The LGA socket includes an insulating housing, at least a pair of bias spring arms integrally formed with the insulating housing or assembled to the insulating housing, and at least a pair of rigid posts extending from a bottom surface of the insulating housing, serving as supporting and locating members of the LGA socket. The insulating housing includes an array of holes therein that hold socket contacts in a pattern that corresponds to a pattern of contacts provided on the bottom of the chip. The bias spring arms locate and position the chip with respect to the socket such that the chip contacts align and engage socket contacts to facilitate electrical communication between the chip and the circuit board. When the chip is positioned on the housing, the chip and socket contacts are placed under a desired vertical load between the circuit board and the chip.

However, existing LGA socket have experienced certain limitations, such as an unduly limited range of injury tolerance. That too many contacts received in the housing and vertical force imported on the chip will result in damages of the housing. More specifically, the insulating rigid posts are not effective for supporting and locating the socket. Therefore, a need exists for an improved electrical connector assembly that address the above noted problems and others experienced heretofore.

SUMMARY OF THE INVENTION

An object of the present invention is to provide an electrical connector assembly with alignment posts which provide sufficient support for the electrical connector assembly.

To achieve the object above, there provided an electrical connector assembly comprising: a frame defining a central cavity therein and a connector assembled to the central cavity. At least one alignment post assembled to the frame and each alignment post defining a middle stop section and an upper latching section consisting of number of latching ribs symmetrically arranged around a circle and a lower engaging section formed with a plurality of ribs around outer periphery. There the frame defining at least one locating hole for said alignment post extending through and the frame is sandwiched between the latching section and the stop section of the at least alignment post.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
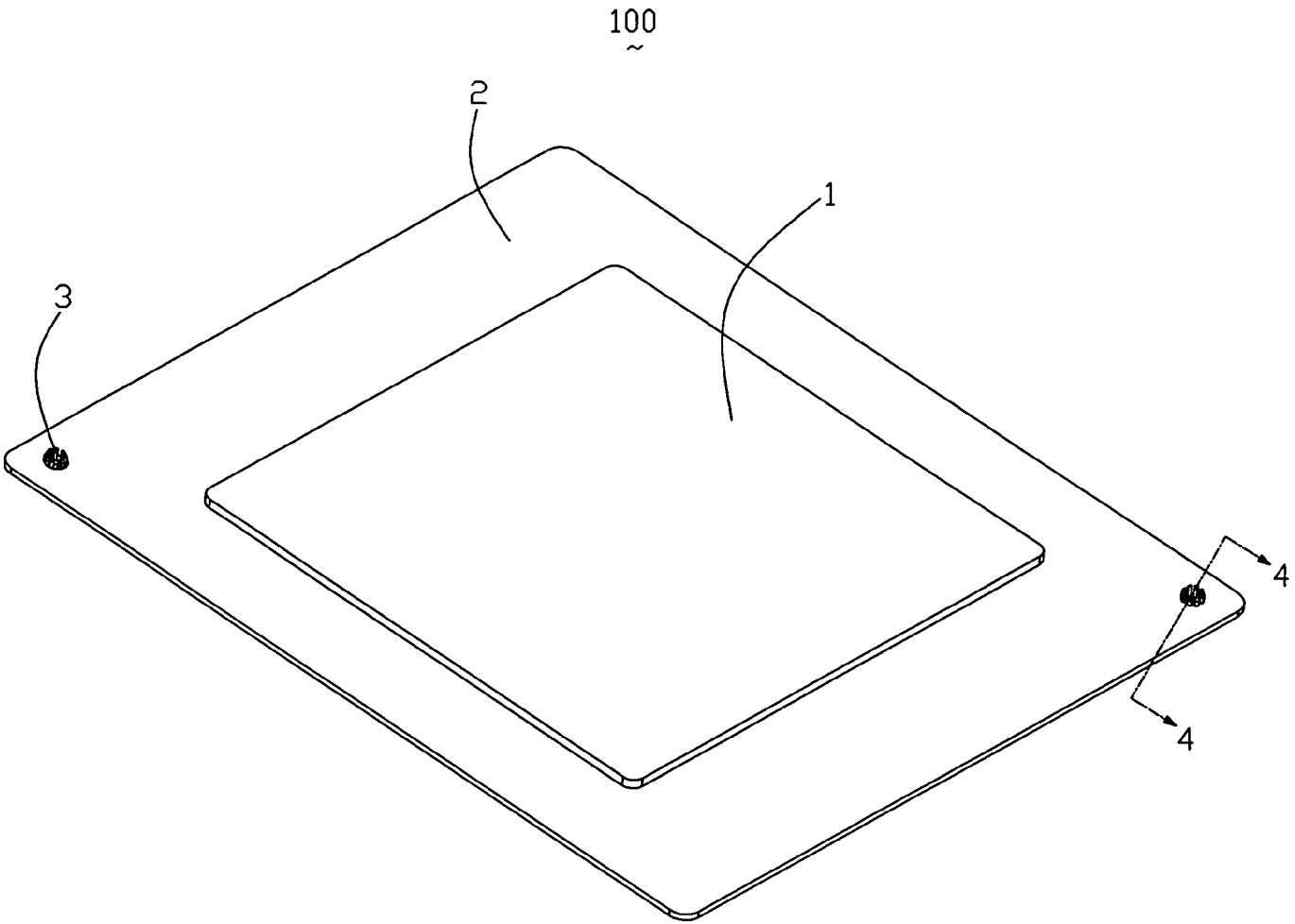
FIG. 1 is an assembled, perspective view of an electrical connector assembly according to a preferred embodiment of the present invention.
Figure 2:
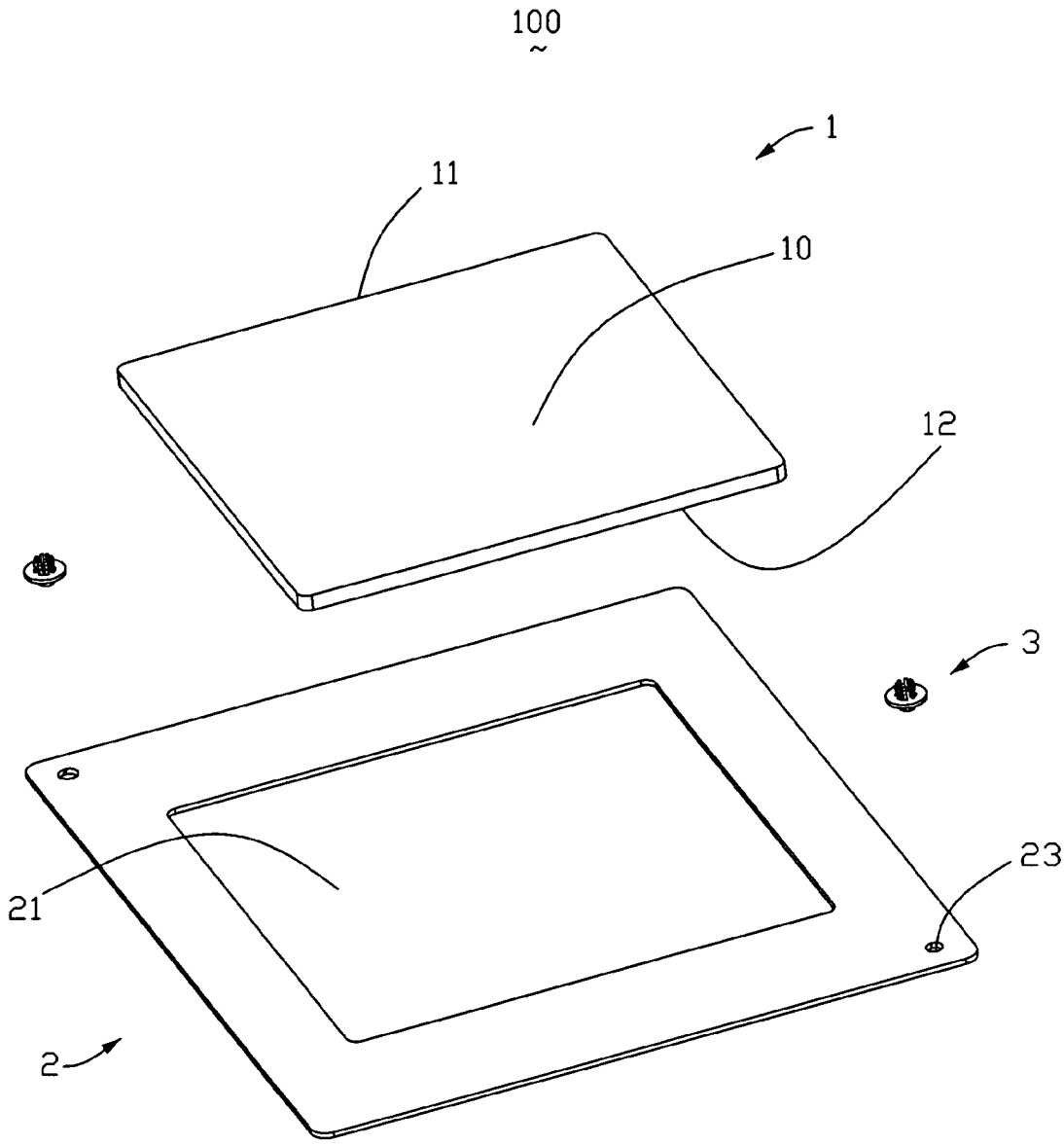
FIG. 2 is an exploded, perspective view of the electrical connector assembly of FIG. 1.

Referring to FIGS. 1 to 2, an electrical connector assembly 100 according to a preferred embodiment of the present invention includes a frame 2 of metal material, an insulating housing 1 retaining an array of resilient conductive contacts in a pattern corresponding to that of chip package contacts and supported by the frame 2, and a pair of alignment posts 3 formed of resilient non-conductive material and disposed and retained in a pair of locating holes 23 in side corners of the frame 2.

The frame 2 is generally square or rectangular in shape and has four side edges 20 together defining a hollow central cavity 21. The frame 2 is preferably formed as an integrally metal part and is sized to accommodate the insulating housing 1. The pair of locating holes 23 penetrates through the side edges 20 of the frame 2 along vertical direction and is arranged along the diagonal direction of the frame 2.

The insulating housing 1 has a shape in compliance with the central cavity 21 defined by the frame 2. An array of vertical passageways (not shown) extends through an upper mating surface 11 and an opposite bottom mounting surface 12 of the insulating housing 1 for receiving the corresponding contacts. A conductive district 10 is formed in the central of the insulating housing 1. In an uncompressed state, the contacts extend approximately 0.010 inch above the mating surface 11 so contacts arranged on the bottom surface of a chip package (not shown) compressively engage the top ends of the contacts when the chip package is mounted to the insulating housing 1.

Figure 3:
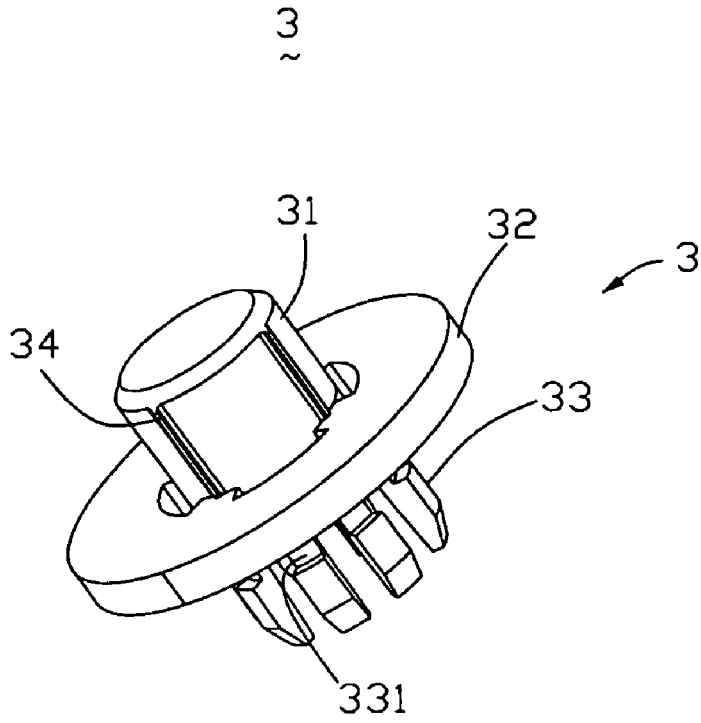
FIG. 3 is an enlarged view of an alignment post of the electrical connector assembly of FIG. 1.
Figure 4:
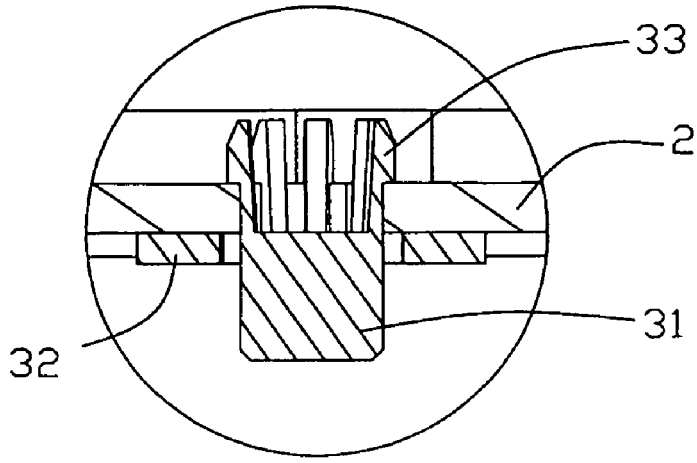
FIG. 4 is a partially cross-section view taken along line 4-4 of FIG. 1.

Referring to FIGS. 3 to 4, the electrical connector assembly 100 also includes the at least a pair of alignment posts 3 snuggly received in the locating holes 23. Each of the alignment posts 3 is stepped in shape to form a middle annular stop section 32, an upper latching section 33 consisting of eight latching ribs 331 symmetrically arranged around a circle and a lower column-shape engaging section 31 formed with a plurality of ribs 34 around outer periphery thereof. Each alignment post 3 is assembled to the locating holes 23 from a bottom surface of the frame 2. The latching ribs 331 of the latching section 33 are disposed with slanted surfaces for facilitating inserting through the locating hole 23, then each latching rib 331 expands outwardly to abut against upper surface of the frame 2 via protrusions formed with each latching rib 331. The annular stop section 32 has a large diameter than the latching section 33 and the engaging section 31 to abut against the bottom surface of the frame 2 for stopping function. While the engaging section 31 is exposed beyond the bottom surface of the frame 2 for inserting into holes of a circuit board via ribs 34 interferentially engaging with the holes.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector assembly comprising:

a frame defining a central cavity therein, the frame having a top surface and a bottom surface;

a connector received in and surrounded by the central cavity, the connector having a top surface higher than the top surface of the frame;

at least one alignment post assembled to the frame and each alignment post defining a middle stop section and an upper latching section consisting of number of latching ribs arranged around a circle and a lower engaging section formed with a plurality of ribs around outer periphery; and the frame defining at least one locating hole for said alignment post extending through, the latching section extending through the frame along a bottom-to-top direction, the latching ribs latching with the top surface of the frame, the stop section engaging with the bottom surface of the frame.

2. The electrical connector assembly as recited in claim 1, wherein frame defines a pair of locating holes arranged along a diagonal direction thereof, and wherein the at least one alignment post is a pair of alignment posts interferentially received in the said pair of locating holes of the frame.

3. The electrical connector assembly as recited in claim 1, wherein the latch section of the alignment post abuts against the top surface of the frame, and the stop section of the alignment post abuts against the bottom surface of the frame.

4. The electrical connector assembly as recited in claim 3, wherein the upper latching section consisting of eight symmetrically latching ribs.

5. The electrical connector assembly as recited in claim 4, wherein each latching rib expands outwardly to abut against said upper surface of the frame via protrusions formed on each latching rib.

6. The electrical connector assembly as recited in claim 1, wherein the engaging section is generally column-shape and includes a plurality of ribs around outer periphery thereof.

7. The electrical connector assembly as recited in claim 1, wherein the stop section is annular and has a diameter larger than both of that of the latching section and that of the engaging section.

8. The electrical connector assembly as recited in claim 1, wherein each alignment post is assembled to the locating hole from a bottom surface of the frame.

9. The electrical connector assembly as recited in claim 1, wherein the frame is generally square or rectangular shape and includes four edges together defining the central cavity.

10. The electrical connector assembly as recited in claim 1, wherein the frame and the alignment post are made from a same type material.

11. The electrical connector assembly as recited in claim 1, wherein the frame and the alignment post are made from different types of material.

12. An electrical connector assembly comprising:

an connector sub-assembly defining a connector body and a frame surrounding said connector body;

a through hole defined in the frame;

a post defining a supporting plate intimately under a bottom face of the frame, a column extending downwardly from a center portion of the supporting plate, and a plurality of deflectable latches arranged around the center portion at intervals in a small circle with corresponding outward hooks on top portions thereof to downwardly abut against a top face of the frame which is opposite to the bottom face.

13. The electrical connector assembly as claimed in claim 12, wherein said supporting plate defining a plurality of through holes in vertical alignment with the corresponding hooks, respectively.

14. The electrical connector assembly as claimed in claim 13, wherein said though holes are arranged in a large circle around said center portion.

15. The electrical connector assembly as claimed in claim 14, wherein said column is solid.

16. The electrical connector assembly as claimed in claim 14, wherein a plurality of spaced projections inwardly extend toward and are terminated at the column from said large circle of the supporting plate of the post to separate said through holes from one another.

17. An electrical connector assembly comprising:

an connector sub-assembly defining a connector body and a frame surrounding said connector body;

a through hole defined in the frame;

a post defining a supporting plate intimately under a bottom face of the frame, a column extending downwardly from a center portion of the supporting plate, and a plurality of deflectable latches arranged around the center portion at intervals in a small circle with corresponding outward hooks on top portions thereof to downwardly abut against a top face of the frame which is opposite to the bottom face, the supporting plate defining a plurality of through holes in vertical alignment with the corresponding hooks, respectively.

* * * * *